US006305151B1

(12) United States Patent
Schoenegg et al.

(10) Patent No.: US 6,305,151 B1
(45) **Date of Patent: *Oct. 23, 2001**

(54) METHOD AND DEVICE FOR SHAPING AND PORTIONING A SOFT, PASTY PRODUCT

(75) Inventors: Klaus Schoenegg, Friedrichshafen; Roland Zeuschner, Argenbuehl-Siggen, both of (DE)

(73) Assignee: Natec, Reich, Summer GmbH & Co. KG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/232,605

(22) Filed: Jan. 19, 1999

(30) Foreign Application Priority Data

Jan. 16, 1998 (DE) ..... 198 01 402

(51) Int. Cl.[7] ..... B65B 9/06
(52) U.S. Cl. ..... 53/551; 53/439; 100/168
(58) Field of Search ..... 53/551, 439; 100/168

(56) References Cited

U.S. PATENT DOCUMENTS

| | | | | |
|---|---|---|---|---|
| 3,001,348 | | 9/1961 | Rado | 53/182 |
| 3,578,217 | * | 5/1971 | Miller | 222/218 |
| 3,711,089 | * | 1/1973 | Reinhard | 272/57 |
| 3,744,278 | * | 7/1973 | Richter et al. | 69/42 |
| 3,772,848 | * | 11/1973 | Rudszinat et al. | 53/24 |
| 3,968,904 | * | 7/1976 | Neville | 222/25 |
| 3,995,517 | * | 12/1976 | Smith | 83/13 |
| 4,015,021 | | 3/1977 | Harima et al. | 426/393 |
| 4,543,769 | | 10/1985 | Schmitz | 53/450 |
| 4,610,126 | * | 9/1986 | DeSantis | 53/475 |
| 4,695,345 | * | 9/1987 | Grace | 156/264 |
| 4,731,250 | | 3/1988 | Stark | 426/234 |
| 4,928,473 | * | 5/1990 | Nagao et al. | 53/53 |
| 5,067,310 | * | 11/1991 | Yamanaka | 53/551 |
| 5,112,632 | * | 5/1992 | Meli et al. | 426/392 |
| 5,182,128 | * | 1/1993 | Laplace | 426/410 |
| 5,222,346 | | 6/1993 | Wegscheider et al. | 53/440 |
| 5,409,358 | * | 4/1995 | Song | 418/63 |
| 5,440,860 | | 8/1995 | Meli et al. | 53/451 |
| 5,711,976 | * | 1/1998 | Abler | 426/36 |
| 5,822,949 | * | 10/1998 | Naoi | 53/55 |
| 5,832,700 | * | 11/1998 | Kammler et al. | 53/502 |
| 5,890,342 | * | 4/1999 | McDonald et al. | 53/54 |
| 5,901,529 | | 5/1999 | Baur | 53/428 |

FOREIGN PATENT DOCUMENTS

| | | | |
|---|---|---|---|
| 1012404 | 6/1977 | (CA) . | |
| 38 41 945 | 12/1988 | (DE) | B65B/9/12 |
| 503 781 | 9/1992 | (EP) | B65B/9/12 |

* cited by examiner

*Primary Examiner*—Peter Vo
*Assistant Examiner*—Christopher R Harmon
(74) *Attorney, Agent, or Firm*—Whyte Hirschboeck Dudek SC

(57) ABSTRACT

The invention relates to a method and a device for shaping and portioning a soft, pasty product within a tubular casing made of foil material, the encased product being supplied to a shaping and portioning station. The product leaves said shaping and portioning station divided into portions. The invention further comprises a metering station arranged directly upstream of the shaping and portioning station. The metering station meters the quantity of the product supplied to shaping and portioning station per unit of time.

20 Claims, 3 Drawing Sheets

METHOD AND DEVICE FOR SHAPING AND PORTIONING A SOFT, PASTY PRODUCT

BACKGROUND OF THE INVENTION

1. Field of the Invention

The invention relates to a method and a device for shaping and portioning a soft, pasty product within a tubular casing of foil material according to the preamble of the independent claims.

2. Description of Relevant Art

Methods and devices of this type are known, for example, in the field of foodstuffs technology for portioning cheese into slice-like, plate-shaped form. DE 195 01 106 A1 of the same Applicants discloses a method of this type and the associated device. In this case, the product provided with a casing is shaped between two shaping elements, which are preferably constructed as circulating belts with webs, and is portioned into individual slices. However, in this case the product is portioned in a cold, relatively solid state.

A shaping device for packing a soft product is known from DE 38 41 945 A1, in which the encased product is also guided between two belts provided with clamping members, and is thereby provided with its intended shape. Since the product is processed in a relatively fluid state in this case, it is difficult to obtain a specific weight for each slice of cheese. Consequently, the belts which face one another extend in this case between two parallel, smooth plates, whose distance from one another is variable. In this manner, it is possible to vary the volume of the portions formed in the casing between successive clamping members. However, a disadvantage in this case is the relatively complex construction, since it is necessary to provide the adjustable plate arrangement within the circulating belt drives. The belts slide continuously along the plates, so that a high degree of belt wear has to be taken into account.

It is therefore the object of the present invention to propose a method and a device for shaping and portioning a soft, pasty product, in which the quantity or the volume of the product supplied to the shaping and portioning station can be adjusted at any time.

SUMMARY OF THE INVENTION

This object is attained according to the invention by the features disclosed in the characterizing part of the independent claims. In particular, in one aspect of the invention, a method for shaping and portioning a soft, pasty product within a tubular casing is disclosed. The method includes the steps of passing a product encased within a tubular casing through a metering station, metering a quantity of the product per unit of time, supplying the metered product to a shaping and portioning station, and portioning the metered product into portions in the shaping and portioning station.

In another aspect of the invention, a device for shaping and portioning a soft, pasty product within a tubular casino made of a foil material includes a shaping and portioning station, to which the encased product is supplied. The encased product leaves the shaping and portioning station in divided portions. A metering station is arranged directly upstream of the shaping and portioning station, in order to meter a quantity of the product supplied to the shaping and portioning station per unit of time.

Advantageous embodiments and further developments of the invention form the subject matter of the dependent claims.

In order to meter the quantity or volume of the encased product supplied to the shaping and portioning station, a metering station is provided according to the invention, which is arranged upstream of the product advance immediately prior to the shaping and portioning station.

DETAILED DESCRIPTION OF THE INVENTION

Figure 1:
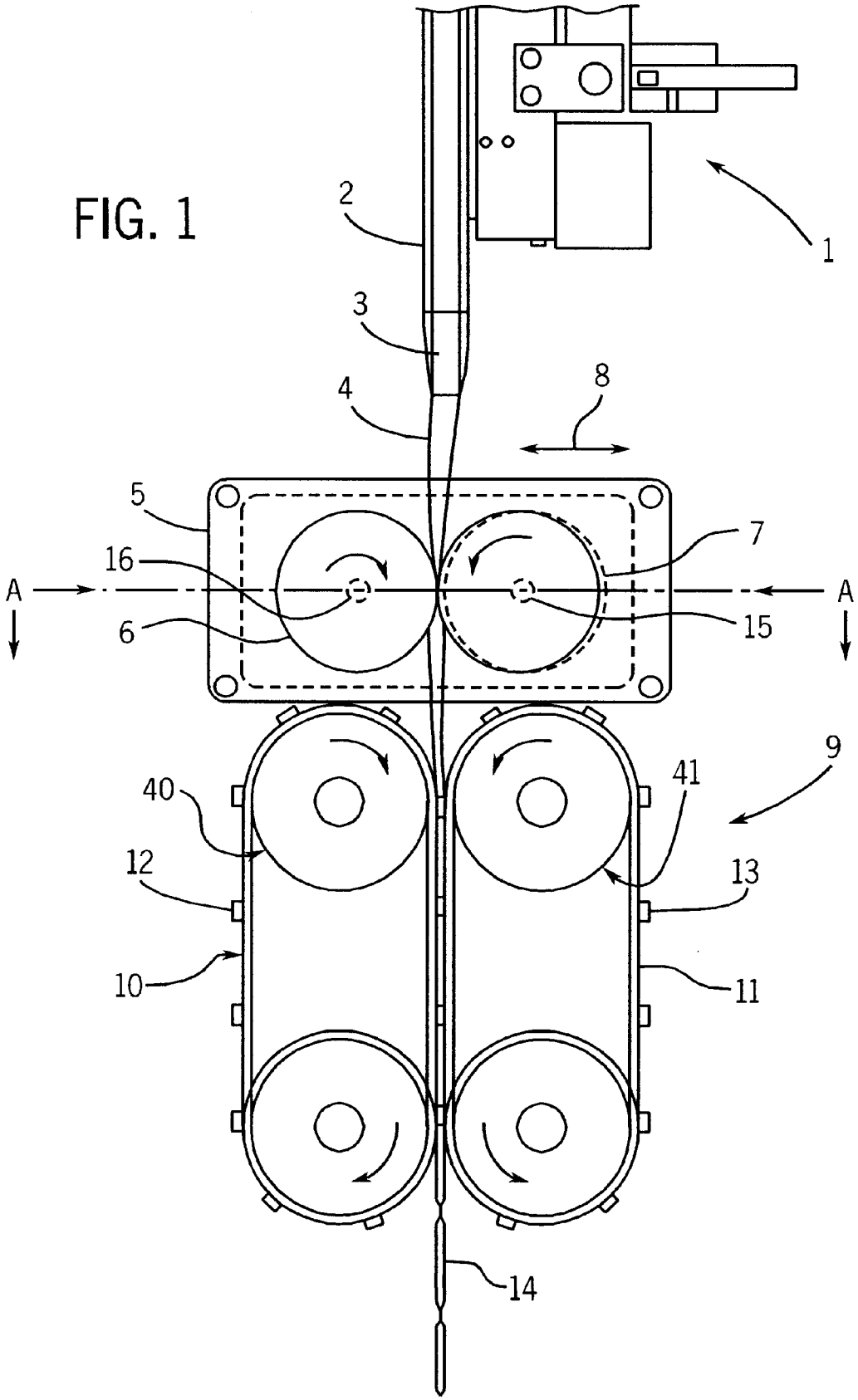
FIG. 1 depicts a side view of one embodiment of the metering device of the present invention in operational context with product advance and the shaping and portioning station.

The metering station is advantageously formed by two rotatable rollers, which are arranged axially parallel at a reciprocal distance apart and between which the encased product which is to be metered is guided.

By way of a simple variation in the reciprocal distance of the two rollers, it is possible to vary the thickness and therefore the quantity or volume of the product passing through. Advantageously, only one roller is adjustably constructed. In a preferred embodiment, the axle of one roller is mounted on an eccentric to the axis of rotation of the roller so that the roller per se is linearly adjustable relative to the other roller.

The rollers rotate in opposite directions and can be free-running, i.e., not driven. In this case, the rollers are carried along or driven by the friction between the product casing and the roller surface. However, both rollers are preferably driven in opposite directions, the drive being effected at the same velocity as the belt drive of the shaping and portioning station.

The rollers are preferably mounted at one end and are made of stainless steel or another material which meets the hygiene requirements in foodstuffs technology.

The metering station is preferably capable of adjustment of automatic adjustment of the distance between the rollers, and hence the rate of product flow per unit time, in response to the density of the product passing through the metering station. In one preferred embodiment, the distance between the rollers is adjusted to maintain the individually wrapped slices at a preset weight. In one embodiment, the distance between the rollers is automatically adjusted in response to an automatic weighing device which weighs one or more individually wrapped slices produced after the foil tube passes through a shaping and portioning station, a heat sealing station and a station that cuts the heat sealed portions into individually wrapped slices, adjusting for increased space between the rollers when the slices are under a preset weight and adjusting for decreased space between the rollers when the slices are over a preset weight.

The maximum and minimum distance between the rollers may be selected among any which is found suitable for a particular end use application. In one embodiment, the the maximum distance between the rollers is less than 3 mm, more preferably less than 2.2 mm, and the preferred minimum distance between the rollers is less than 0.5 mm, more preferably about twice the thickness of the foil used to make the foil tube. This latter embodiment is particularly useful for interrupting production of individually wrapped slices whereby the opening between the rollers is reduced prior to stopping production to prevent unmetered pasty product from flowing down the foil tube past the metering station during the interruption. The opening is then widened to the desired slice thickness after production is restarted.

The invention will be explained in further detail by way of an embodiment with the aid of FIGS. 1 to 3. As used below, the term "bearings" means components for permitting rotation of a shaft or axle about its axis with reduced friction, such as ball bearings and sleeve bearings.

The device for shaping and portioning is part of a device for packing a soft, pasty product in a casing of foil material, preferably plastics material foil. The flat plastics material foil is withdrawn from a supply roll and supplied to a device which forms a foil tubing from the flat foil (not shown in the drawing). The foil tubing 4 is guided along a shaping tube 2 and welded by a longitudinal seam station with the aid of a heating element 1. Extending within the shaping tube 2 is a filling pipe 3, through which the soft, pasty product is introduced into the foil tubing 4. An example of a device which is capable of these functions is provided by U.S. Pat. No. 5,222,346, which is incorporated herein by reference.

The foil tubing 4, which contains the product which is to be shaped, then passes to the metering station 5.

The metering station 5 comprises a frame 5*a*, which has mounted within it two (first and second) rollers 6, 7, which are rotatable about their axles 15, 16 and are arranged at a distance from one another. The foil tubing 4 is introduced into the space between the rollers, so that the foil tubing 4 and the product contained therein is compressed to a thickness corresponding to the distance between the rollers 6, 7 and leaves the metering station 5 in this form. By means of the rollers 6, 7, a metering of the quantity of the product passing through the metering station per unit of time is therefore effected.

The rollers 6, 7 rotate in opposite directions and can be free-running, i.e., not driven. In this case, they are set in rotation by the friction of the product-filled foil tubing 4 passing through the rollers. In an advantageous embodiment, the two rollers 6, 7 are driven in opposite directions and are driven at the velocity of the foil passing through them, such as by drive linkage(s) connected to the rotating elements of the shaping and portioning station.

At least one of the rollers is adjustably constructed, so that the distance between the rollers and therefore also the thickness of the product disposed in the foil tubing can be adjusted. In this respect, the adjustment of the roller 7, for example, is effected in the direction of the arrow 8 as shown by the dashed lined near the outer circumference of roller 7 in FIG. 1 (indicating a new position occupied by roller 7 when the space between the rollers is increased).

The flattened foil tubing 4 leaving the metering station 5 and containing the product subsequently enters the shaping and portioning station 9, which in the example is formed by two continuous belts 10, 11, to which cleats 12, 13 are secured in each case. The encased, flattened, metered product now passes between the continuous belts 10, 11, the cleats 12, 13 being forced together with the constant rotation of the continuous belts 10, 11, so that the product is displaced in the region of the cleats 12, 13 which are forced together and is divided into portions 14, which leave the shaping and portioning unit.

In the region between the portions 14, the foil tubing is then welded in a suitable device, resulting in portions 14 which are hermetically sealed relative to one another (not shown in the drawing). Following the welding, the portions can be cut into individually wrapped slices. An example of a device capable of carrying out these functions is provided by U.S. Pat. No. 5,222,346, which is already incorporated herein by reference.

Figure 2:
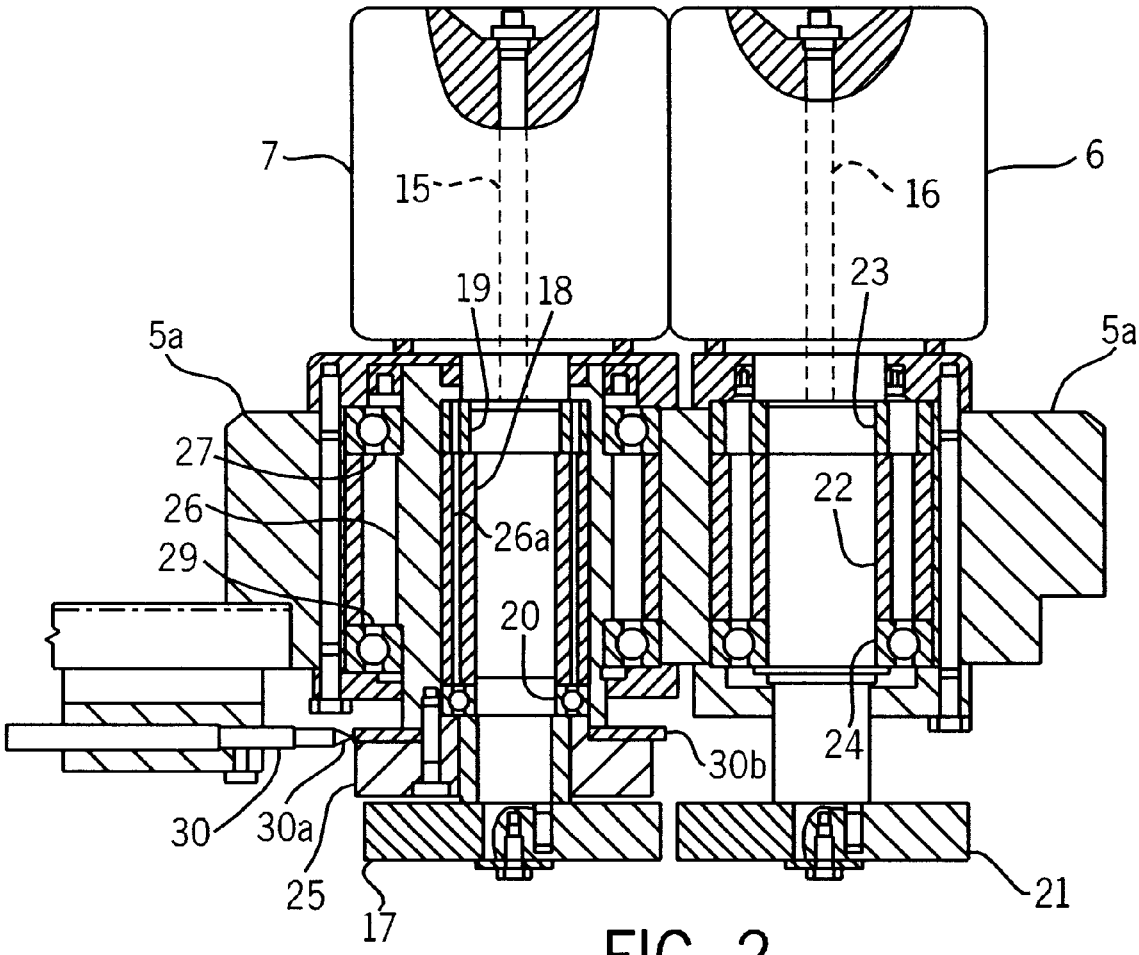
FIG. 2 depicts an enlarged downward horizontal cross-sectional view of the metering device depicted in FIG. 1 taken at "A" of FIG. 1.

FIG. 2 depicts an enlarged downward horizontal cross-sectional view of the metering device depicted in FIG. 1 taken at "A" of FIG. 1. Reference numerals in FIG. 2 corresponding to those in FIG. 1 refer to the same parts as in FIG. 1. As can be seen in FIG. 2, axle 15 is fixedly connected to roller 7 at one end at a location coinciding with the axis of rotation of roller 7. Axle 15 is also fixedly connected to a first hollow shaft 18 at the end opposite the end connected to roller 7. The first hollow shaft 18 is fixedly connected to pully 17 (which is connected to a drive, not shown) and rotates within an eccentric rotatable hollow shaft 26 via circular bearing races 19 and 20, containing bearings, located proximate to the distal ends of hollow shaft 18.

Axle 16 is fixedly connected to roller 6 on one end at a location coinciding with the axis of rotation of roller 6. Axle 16 is also fixedly connected to a second hollow shaft 22 at the end opposite to that connected to roller 6. The second hollow shaft 22 is fixedly connected to pully 21 (which is connected to a drive, not shown). The second hollow shaft 22 rotates within frame 5*a* via circular bearing races 23 and 24, also containing bearings, and also located proximate to the distal ends of shaft 22.

Eccentric rotatable hollow shaft 26 has a cylidrically shaped inner surface 26*a* adapted for accepting the rotatable hollow shaft 18 and is rotatably mounted within frame 5*a* via circular bearing races 27 and 29, each containing bearings, located proximate to the distal ends of the rotatable hollow shaft 26. The circular bearing races 27 and 29 are off-center from the axis of rotation of axle 15 in the same direction so that the eccentric rotatable hollow shaft 26 has an axis of rotation parallel to, but off-center from, the axis of rotation of the rollers. When eccentric rotatable shaft 26 is rotated, the distance between the rollers, and therefore also the thickness of the product disposed in the foil tubing, can be adjusted as shown in FIG. 1.

The degree of offset, and hence the maximum and minimum distance between rollers 6,7, may be selected among any which is found suitable for a particular end use application. In one embodiment, the degree of offset (i.e., the distance between the axis of rotation of axle 15 and the axis of rotation of eccentric rotatable hollow shaft 26) is selected so that the maximum distance between rollers 6,7 is less than 3 mm. In a preferred embodiment, the degree of offset is selected so that the minimum distance between rollers 6,7 is less than 0.5 mm, more preferably about twice the thickness of the foil used to make the foil tube.

In this preferred embodiment, eccentric rotatable hollow shaft 26 is fixedly connected to pully 25, which is connected via a chain or belt to a servo-motor (not shown). A distance measuring device 30 having a probe 30*a* is preferably in substantial alignment with directional vector arrow 8 in FIG. 1. The distance measuring device preferably is capable of adjustment of its probe 30*a* toward and away from the eccentric rotatable hollow shaft 26 by coming in contact with contact surface 30*b*, which is a circular surface concentric with the axis of rotation of eccentric rotatable hollow shaft 26, and is capable of providing a signal to the servo-motor to rotate the eccentric rotatable hollow shaft 26 in a direction which maintains the distance set via the distance measuring device. In a particularly preferred embodiment, the distance measuring device is adapted to receive a signal from an automatic weighing device which weighs one or more individually wrapped slices produced after the foil tube passes through a shaping and portioning station, a heat sealing station and a station that cuts the heat sealed portions into individually wrapped slices and adjust for increased space between rollers 6,7 when the slices are under a preset weight and adjust for decreased space between rollers 6,7 when the slices are over a preset weight.

Figure 3:
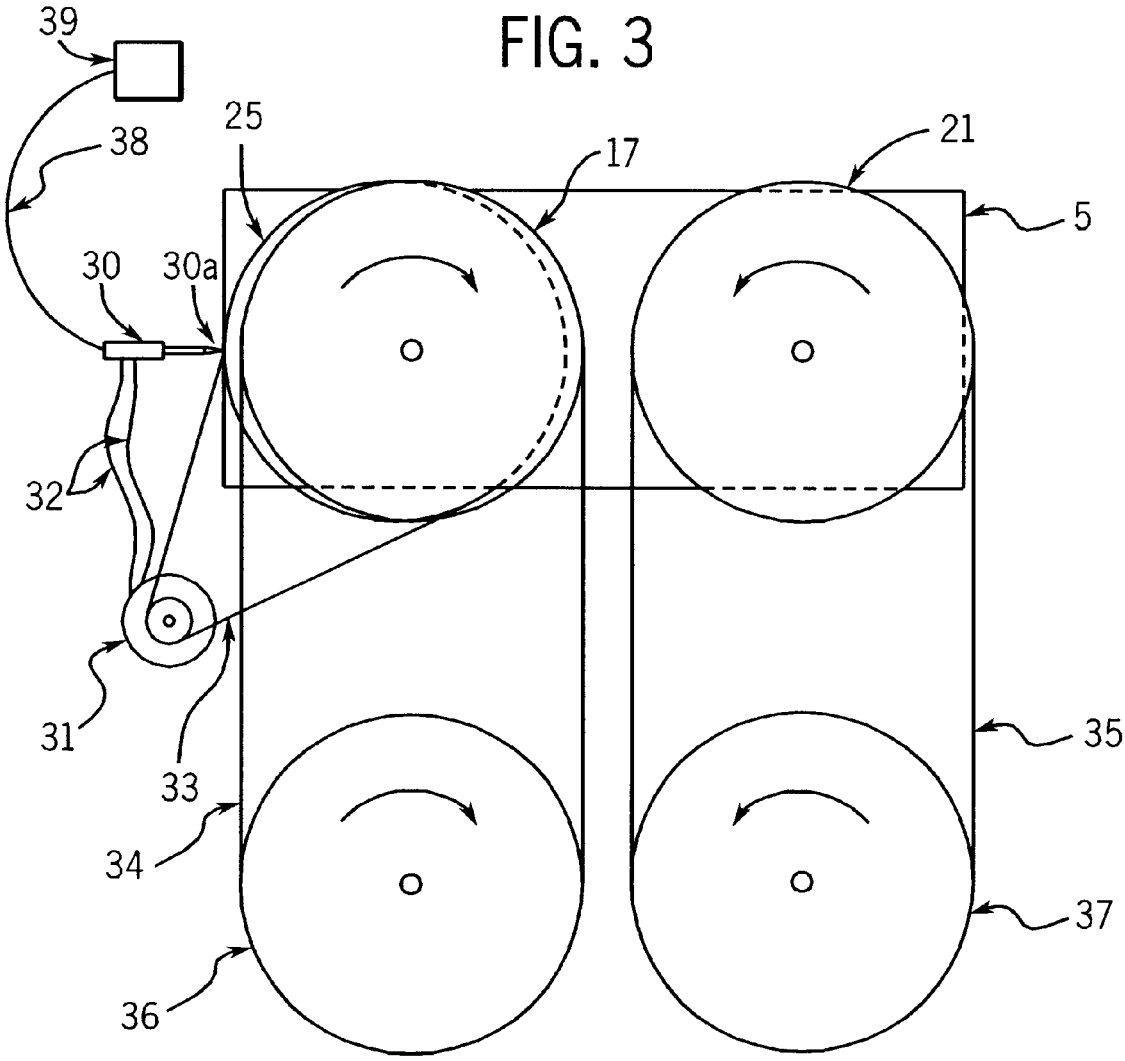
FIG. 3 is a schematic diagram of the metering device of the invention portrayed from the side opposite that shown in FIG. 1.

FIG. 3 is a schematic diagram showing the metering station 5 from the side opposite to that shown in FIG. 1. Pulleys 17 and 21 are driven via belts 34 and 35, respectively, by pulleys 36 and 37, respectively, which are fixedly connected to drive rollers 40 and 41, respectively, for driving belts 10 and 11, respectively, of shaping and portioning station 9 (shown in FIG. 1). Pully 25 for eccentric rotatable hollow shaft 26 is connected via belt 33 to servo-motor 31. Servo-motor 31 is connected via electrical connection 32 to distance measuring device 30 which is also connected via connection 38 to weighing device 39. Signals from weighing device 39 adjust the distance of distance measuring device probe 30*a* from contact surface 30*b* and signals from probe 30*a* signal the servo-motor to turn pulley 25 to increase or decrease the distance between the rollers as required.

A significant advantage of the invention is that a precise quantity metering of the product supplied to the shaping and portioning station 9, which can be easily varied at any time, is possible by way of a simply constructed metering station 5 at the entrance to the shaping and portioning station 9. When the metering is based on weight of one or more individually wrapped slices, the invention is able to accurately maintain a preset weight despite variations in the density of the pasty product as it is introduced into the foil tube.

Thus, portions of a constant quantity and packing quality can be produced in a simple manner. A quantity metering prior to portioning is particularly necessary in the case of products which are very fluid, in order to attain a clean shaping of the product.

Legend to Drawing

1 longitudinal seam station
2 shaping tube
3 filling tube
4 foil tubing
5 metering station
5*a* metering station frame
6 first roller
7 second roller
8 arrow showing direction of roller 7 adjustment
9 shaping and portioning station
10 first continuous belt
11 second continuous belt
12 cleat
13 cleat
14 portion
15 first axle
16 second axle
17 first pulley
18 first rotatable hollow shaft
19 first race of bearings for first shaft
20 second race of bearings for first shaft
21 second pulley
22 second rotatable hollow shaft
23 first race of bearings for second shaft
24 second race of bearings for second shaft
25 pulley for eccentric shaft
26 eccentric shaft
26*a* cylindrical inner surface
27 first bearing race for eccentric shaft
28 [RESERVED]
29 second bearing race for eccentric shaft
30 distance measuring device
30*a* distance measuring device probe
30*b* contact surface for probe
31 servo-motor
32 connecting leads
33 eccentric shaft pulley belt
34 first pulley belt
35 second pulley belt
36 first shaping and portioning station pulley
37 second shaping and portioning station pulley
38 connecting control lead
39 weighing device
40 first drive roller for belt 10
41 second drive roller for belt 11

What is claimed is:

1. A method for shaping and portioning a soft, pasty product within a tubular casing comprising the steps of:

passing an unmetered soft, pasty product encased within a tubular casing through a metering station;

metering a quantity of the product per unit of time to obtain a metered product by rotating two rollers in opposite directions, the rollers arranged axially parallel at a distance apart from one another;

supplying the metered product to a shaping and portioning station;

portioning the metered product into portions in the shaping and portioning station;

monitoring the density of the product; and automatically adjusting the distance between the rollers in response to changes in the density of the product by linearly adjusting at least one of the rollers with respect to the other roller;

wherein the device permits interruption of the supplying and portioning steps such that the device is capable of preventing unmetered pasty product from flowing through the tubular casing and through the metering station; and wherein the device is capable of accurately maintaining a preset weight of the pasty product despite variations in pasty product density.

2. The method according to claim 1, wherein the rollers are free running.

3. The method according to claim 1, further including a step of driving the rollers with rotating elements of the shaping and portioning station.

4. The method according to claim 1, wherein the adjusting step includes mounting at least one of the rollers with respect to an axis of rotation of the other roller such that the distance between the rollers can be adjusted to a distance corresponding to a desired thickness of the product.

5. A device for shaping and portioning a soft, pasty product within a tubular casing made of a plastic foil material, comprising:

a shaping and portioning station, to which the soft, pasty encased product is supplied and from which the encased product leaves in divided portions; and a metering station arranged directly upstream of the shaping and portioning station, to meter a quantity of the product supplied to the shaping, and portioning station per unit of time;

means for monitoring the density of the product;

wherein the device permits interruption of the supplying and portioning steps such that the device is capable of preventing unmetered encased pasty product from flowing through the metering station; and wherein the device is capable of accurately maintaining a preset weight of the product despite variations in product density.

6. The device according to claim 5, wherein the metering station further comprises rotatable rollers arranged axially parallel at a distance from one another.

7. The device according to claim 6, wherein the rotatable rollers are arranged in a free-running manner.

8. The device according to claim 6, further comprising a drive and wherein the rotatable rollers are driven in opposite rotational directions by the drive.

9. The device according to claim 6, wherein at least one rotatable roller includes an adjusting device for adjusting the distance between the rotatable rollers.

10. The device according to claim 9, wherein each rotatable roller is mounted on an axle.

11. The device according to claim 6, wherein each rotatable roller is made of stainless steel.

12. The device according to claim 10, wherein the adjusting device further comprises:

at least one rotatable hollow shaft rotatably mounted within a frame; and wherein one of the roller axles is rotatably mounted within one of the rotatable hollow shafts such that the roller axle is parallel to an axis of rotation of the rotatable hollow shaft.

13. The device according to claim 12, wherein the rotatable hollow shaft is connected to a servo-motor for rotating the rotatable hollow shaft.

14. The device according to claim 6, wherein the metering station is operatively associated with an automatic weighing device such that the distance between the rotatable rollers is automatically adjusted in response to signals from the automatic weighing device in order to maintain the portions at a preset weight.

15. The device according to claim 13, wherein the servo-motor is operatively associated with an automatic weighing device such that the distance between the rotatable rollers is automatically adjusted in response to signals from the automatic weighing device in order to maintain the portions at a preset weight.

16. The device according to claim 14, wherein the metering station includes a distance measuring device to detect deviations in the distance between the rotatable rollers.

17. The device according to claim 16, wherein the distance measuring device is operatively associated with the automatic weighing device to automatically adjust the distance between the rotatable rollers in response to signals received from the automatic weighing device.

18. A device for shaping and portioning a soft, pasty product within a tubular casing, the casing made of a plastic foil material, the device comprising:

a shaping and portioning station to which the encased product, the casing made of the plastic foil material, is supplied and from which the encased product leaves in divided portions; and a metering station comprising a frame, the station in operative association with an automatic weighing device arranged directly upstream of the shaping and portioning station to meter a quantity of the product supplied to the shaping and portioning station per unit of time, the metering station further comprising:

rotatable rollers, each of the rollers mounted to the frame and each of the rollers being arranged axially parallel at a distance apart from one another; and an adjusting device for adjusting the distance between the rotatable rollers such that the distance between the rollers can be automatically adjusted by linearly adjusting at least one of the rollers with respect to another of the rollers in response to signals from the automatic weighing device in order to maintain the portions at a preset weight, the adjusting device in operative association with at least one of the rollers;

means for accurately maintaining a preset weight of the product despite variations in product density; and means for preventing unmetered, encased soft, pasty product from flowing through the metering station.

19. A method for shaping and portioning a soft, pasty product, the method comprising:

passing an encased, soft, pasty product through a metering station;

metering a quantity of the product per unit of time to obtain a metered product by rotating two rollers in opposition directions, the rollers arranged axially parallel at a distance apart from one another, the distance defining a product space through which the product passes;

supplying the metered product to a shaping and portioning station;

portioning the metered product into individual product portions in the shaping and portioning station; and maintaining a preset weight of the product despite variations in product density by weighing the individual portions, generating a weight signal for each of the individual portions, comparing the weight signal to a preset portion weight, and using the weight signal to determine whether the product space should be adjusted based upon whether the portion weight is over or under the preset portion weight, and if so, automatically adjusting the distance between the rollers in response to changes in the density of the product.

20. A device for shaping and portioning an encased, soft, pasty product, the device comprising:

a shaping and portioning station to which the encased, soft, pasty product is supplied and from which the product leaves in divided portions; and a metering station arranged directly upstream of the shaping and portioning station, to meter a quantity of the product supplied to the shaping and portioning station per unit of time, the metering station comprising two rollers capable of rotating in opposite directions and arranged axially parallel at a distance apart from one another, the distance defining a product space through which the product passes; and means for maintaining a preset weight of the product despite variations in product density by weighing the divided pasty product portions, generating a weight signal for each of the divided portions, comparing the weight signal to a preset portion weight, and determining whether the product space should be adjusted based upon whether the portion weight is over or under the preset portion weight, and if so, automatically adjusting the distance between the rollers in response to changes in the density of the product.

* * * * *